US006324824B1

(12) United States Patent
Cortinovis

(10) Patent No.: US 6,324,824 B1
(45) Date of Patent: Dec. 4, 2001

(54) METHOD AND MACHINE FOR STRANDING TWO CONDUCTORS

(75) Inventor: Sergio Cortinovis, Bergamo (IT)

(73) Assignee: Cortinovis S.p.A., Bergamo (IT)

( * ) Notice: Subject to any disclaimer, the term of this patent is extended or adjusted under 35 U.S.C. 154(b) by 0 days.

(21) Appl. No.: 09/512,038

(22) Filed: Feb. 24, 2000

(30) Foreign Application Priority Data

Mar. 1, 1999 (IT) ..... MI99A0410

(51) Int. Cl.[7] ..... H01B 13/02
(52) U.S. Cl. ..... 57/314; 57/314; 57/311
(58) Field of Search ..... 57/237, 314, 311

(56) References Cited

U.S. PATENT DOCUMENTS 3,732,682 5/1973 Crotty et al. .
4,089,452 5/1978 Houser et al. .
4,335,571 * 6/1982 Tarantola ..... 57/58.52
4,741,097 * 5/1988 D'Agati et al. ..... 29/631
5,505,243 * 4/1996 Imamiya et al. ..... 57/902

* cited by examiner

*Primary Examiner*—Andy Falik
(74) *Attorney, Agent, or Firm*—Guido Modiano; Albert Josif; Daniel O'Byrne

(57) ABSTRACT

Method and machine for stranding two conductors, as two helices offset by a half stranding length in the same winding direction, without turning the conductors about respective axes thereof. The machine includes an arch-type stranding assembly which dispenses the two conductors so that one revolves around the other, a first support located at the exit of the arch-type stranding assembly to provide first contact points for the conductor proximate to a main rotation axis about which a conductor nrevolves around the other, second supports located downstream of the first support along the advancement direction of the two conductors and providing second contact points for the two conductors, and a die located downstream of the second supports to complete the pairing of the conductors. The first support and second supports revolve jointly with a first one of the conductors around the main axis.

14 Claims, 3 Drawing Sheets

METHOD AND MACHINE FOR STRANDING TWO CONDUCTORS

BACKGROUND OF THE INVENTION

The present invention relates to a method and a machine for stranding two conductors in the shape of two helices with the same winding direction or hand, offset by half the stranding length, particularly for highperformance conductors for transmitting signals in the field of communications.

It is known that the single cable used to transmit signals in the field of communications, such as for example the conventional telephone twisted pair, is generally constituted by two insulated conductors, one for the outgoing signal and one for the return signal respectively, which are stranded together, i.e., coupled one another in the form of two helices, having the same winding direction, offset by half the stranding length, in order to increase their elasticity and mechanical strength and to reduce capacity coupling.

Since the stranding length is very small, generally equal to one centimeter, and therefore one turn of the stranding machine for each stranding length is required, and since extremely large volumes of this cable are required, it is usually produced on double-twist stranding machines which have very high productivity in terms of stranding, although these machines subject the conductors to a very "rough" treatment. Stranding produced with these double-twist machines is obtained by "pinching" the conductors, which are therefore also simultaneously "twisted" about themselves.

The double-twist stranding machine in fact matches each rotation for depositing the conductor with a complete axial twist thereof; in other words, if a twisted pair produced by means of a double-twist stranding machine is observed, it can be noticed that each conductor is subjected to a full rotation about its own axis for each stranding length.

This is extremely damaging for the conductors, since the twisting that is applied to the insulating layer that covers the conductors on the one hand cracks it and separates it from the copper and on the other hand subjects the core to pinching and to irregular reductions in cross-section in the points where it yields.

This fact was acceptable in the past in view of the low passband that was required, but it is becoming increasingly intolerable as the required performance of the cable increases, requiring perfect insulations and absolute constancy of the properties of the conductor along the entire path of the signal.

In order to obviate the problem of conductor twisting, stranding machines are currently manufactured which provide preventive partial detwisting, i.e., in which the individual conductor, before being paired, is subjected to a 50–60% twisting which is opposite in sign or hand (detwisting) to the twisting that it will undergo during the subsequent stranding operation, so as to leave, at the end of the process, a conductor with reduced residual twisting.

This refinement provides no substantial advantages with respect to the previous method, since actually it subjects the cable to two processes and therefore to twice as much damage by means of its two inverse and opposite twisting operations, with the effect of separating even more the insulation from the copper, degrading the performance of the cable even more than the preceding double-twist process. The degradation of the performance of the cable does not depend on the absolute residual twisting but on the absolute treatment to which it has been subjected. In practice, although a 180° twisting of the conductor about its own axis and a 360° countertwisting at each stranding length ultimately leave a conductor with an absolute twist of only 180° (360°–180°), it worsens the performance of the conductor as if it had undergone a total of 540° of twisting.

SUMMARY OF THE INVENTION

The aim of the present invention is to solve the above problems, by providing a method which allows to manufacture cables by stranding one another two conductors without altering their core and/or the insulating layer that covers them.

An object of the invention is to provide a method which allows to manufacture cables which ensure high performance in signal transmission and are therefore particularly adapted for use in the field of communications.

Another object of the invention is to provide a machine for carrying out the method according to the invention which allows a high rotation rate of the stranding apparatus and therefore high productivity.

This aim, these and other objects which will become better apparent hereinafter are achieved by a method for stranding two conductors in the shape of two helices with the same winding direction offset by half the stranding length, characterized in that it consists in pairing two wire-like conductors by arranging them in the form of two identical helices, having the same winding direction, which are offset by half the stranding length without turning said conductors about their respective axes.

The method according to the invention is preferably carried out by means of a machine for stranding two conductors in the shape of two helices, having the same winding direction or hand, offset by half the stranding length, which comprises an arch-type stranding assembly dispensing a first conductor and a second conductor so that the first conductor revolves around the second conductor, characterized in that it comprises, at the exit of said arch-type stranding assembly, first supporting means which define first contact points for said two conductors proximate to the rotation axis, or main axis, about which the first conductor revolves around the second conductor and, downstream of the supporting means along the advancement direction of the two conductors, second supporting means defining second points of contact for the two conductors; the second contact points being spaced and arranged symmetrically with respect to each other relative to the main axis; at least the first supporting means for the first conductor and the second supporting means revolving rigidly with the first conductor around the main axis; a die being provided downstream of the second supporting means in order to complete the pairing of the two conductors.

BRIEF DESCRIPTION OF THE DRAWINGS

Further characteristics and advantages of the invention will become apparent from the following description of a preferred but not exclusive embodiment of the method according to the invention and of the machine for carrying out the method, illustrated only by way of non-limitative example in the accompanying drawings, wherein.

DESCRIPTION OF THE PREFERRED EMBODIMENTS

Figure 1:
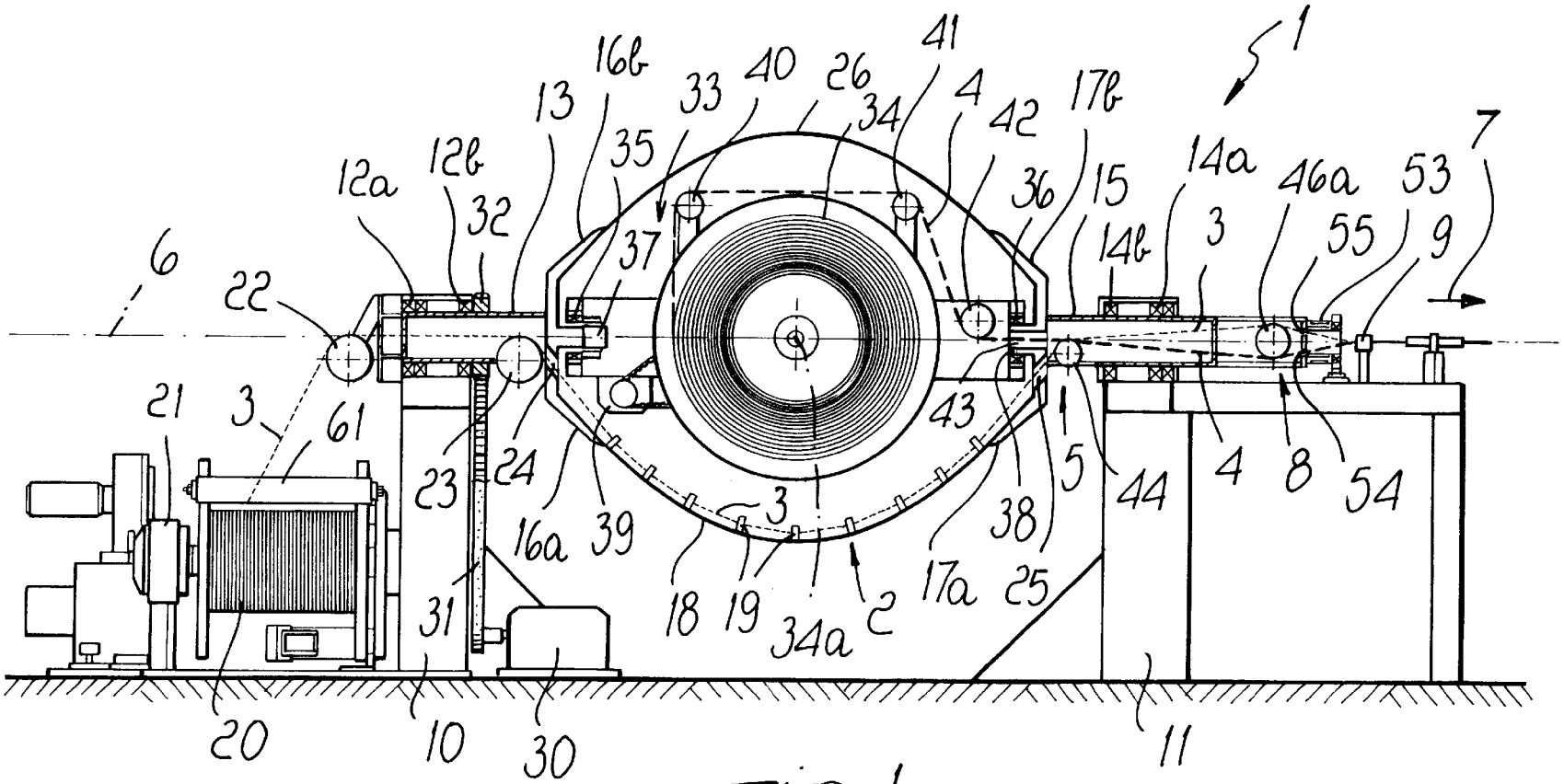
FIG. 1 is a partially sectional schematic lateral elevation view of the machine for carrying out the method according to the invention.

With reference to the above Figures, the machine for carrying out the method according to the invention, generally designated by the reference numeral 1, comprises an arch-type stranding assembly, generally designated by the reference numeral 2, which dispenses in output a first conductor 3 and a second conductor 4 so that the first conductor 3 revolves around the second conductor 4.

At the exit of the arch-type stranding assembly 2, the machine for carrying out the method according to the invention comprises first supporting means 5, which define first contact points for the two conductors 3 and 4 proximate to the rotation axis, or main axis 6, about which the first conductor 3 revolves around the second conductor 4 and, downstream of said supporting means along the advancement direction of the two conductors 3 and 4, indicated by the arrow 7, second supporting means 8 forming second contact points for the conductors 3 and 4.

The second contact points are spaced and arranged symmetrically to each other with respect to the main axis 6. At least the first supporting means for the first conductor 3 and the second supporting means 8 are rigidly coupled, in revolving around the main axis 6, to the first conductor 3.

Downstream of the second supporting means 8 along the advancement direction 7 there is a die 9 which completes the pairing of the two conductors 3 and 4.

More particularly, the arch-type stranding assembly comprises an external static supporting structure which is fixed to the ground and is substantially constituted by two shoulders 10 and 11.

The shoulder 10 supports, so that it can rotate about its own axis, e.g. by interposing bearings 12*a* and 12*b*, a first hollow shaft 13 which is arranged so that its axis coincides with the main axis 6.

The shoulder 11 supports, so that it can rotate about its own axis, e.g. by interposing bearings 14*a* and 14*b*, a second hollow shaft 15 which is arranged coaxially to the first hollow shaft 13.

Two arms 16*a* and 16*b* are fixed to the end of the first hollow shaft 13 that is directed toward the second hollow shaft 15; said arms are mutually rigidly coupled, lie on a same plane which passes through the main axis 6, and are folded toward the second hollow shaft 15.

In the same way, two arms 17*a* and 17*b* are fixed to the end of the second hollow shaft 15 that is directed toward the first hollow shaft 13; said arms are mutually rigidly coupled, lie on the same plane as the arms 16*a* and 16*b* and are folded toward the first hollow shaft 13.

The arm 16*a* is rigidly connected to the arm 17*a* by means of an arch 18. On the side of the arch 18 that is directed toward the main axis 6 adapted brackets 19 are provided for containing the first conductor 3 at rest.

The assembly constituted by the arm 16*a*, the arch 18 and the arm 17*a* defines an arch whose ends are located proximate to the main axis 6 and defines a portion of the path followed by the first conductor 3.

The arms 16*b* and 17*b* are mutually rigidly connected by means of an arch 26 which is designed to counterbalance the arch 18 and to stiffen the connection between the hollow shafts 13 and 15. The arches 18 and 26 lie on a same plane which passes through the main axis 6.

The first conductor 3 is fed to the machine from a first reel 20 which is arranged laterally to the shoulder 10 and is actuated by an unwinding device driven by a first motor 21; from the reel 20, the first conductor 3 passes onto a guiding cylinder 61 and from there the first conductor 3 is guided, through a first pulley 22 which is supported so that it can rotate freely about its own axis by the supporting structure of the machine, so as to coaxially enter the first hollow shaft 13.

Inside the first hollow shaft 13 a second pulley 23 is also provided which is supported by it so that it can rotate freely about its own axis. The second pulley 23 is arranged so that its axis lies in a region which is spaced from the main axis 6, so that its race is tangent to the axis 6. As a result, the path of the first conductor 3 is not altered by the rotation of the hollow shaft 13 (since it coincides with its axis), is not touched at its entry into the shaft even though the entry occurs through a small hole, and is not subjected to twisting although it arrives from an assembly which is fixed with respect to the ground.

The first conductor 3 passes from the second pulley 23 on the side of the arch 18 that is directed toward the main axis 6.

The first conductor 3 can enter the arch 18 through an appropriate passage 24 provided in the arm 16*a*, which also rotates rigidly with the hollow shaft 13 and with the pulley 23, and therefore along a fixed path, inside the revolving assembly constituted by the shafts 13 and 15 and by the corresponding arms 16*a* and 16*b*, 17*a* and 17*b* connected by the arches 18 and 26, which is therefore not affected by the rotation.

In the same way, at the other end of the arch 18 the first conductor 3 can exit through an adapted passage 25 which crosses the arm 17*a*.

As it leaves the arch 18, the first conductor 3 engages the first supporting means 5 and then the second supporting means 8 which support the conductor 3 in the final portion of its path, described in greater detail hereinafter.

Said rotating assembly can be actuated so as to rotate about the axis 6 by a motor 30 whose output shaft is connected, e.g. by means of a toothed belt 31, to a pulley 32 which is keyed to the first hollow shaft 13.

Within the path traced by the arch 18 in revolving around the main axis 6 a frame 33 is provided, on which a second reel 34 is mounted which is excluded from the revolving motion around the main axis 6.

More particularly, the frame 33 is supported, so that it can rotate about the main axis 6, e.g. by interposing bearings 35 and 36, by two center spindles 37 and 38 whose axis coincides with the main axis 6. The center spindles 37 and 38 are rigidly fixed to the first hollow shaft 13 and to the second hollow shaft 15 respectively.

The frame 33 supports the second reel 34 so that it can rotate about its own axis 34*a*. Preferably, the axis 34*a* of the reel 34 intersects at right angles the main axis 6 in the intermediate point of the distance between the shoulders 10 and 11 that constitutes the central point of the entire machine.

The second reel 34 can be rotationally actuated about its own axis 34*a* by a second motor 39 which is mounted on the frame 33.

The second reel 34 feeds the second conductor 4 which, as its leaves the reel, is guided through a first pulley 40, a second pulley 41 and a third pulley 42 which are supported by the frame 33 so as to be rotatable about their respective axes, which are all parallel to each other and to the axis 34*a*.

In particular, the axis of the third pulley 42 is arranged so that its race, with which the second conductor 4 engages, is tangent to the main axis 6. In this way, at the output of the third pulley 42 the second conductor 4 reaches the first supporting means 5, passing along the main axis 6 and crossing an axial passage 43 provided for this purpose in the center spindle 38 at the main axis 6. During this crossing, the second conductor 4 does not interfere at all with the center spindle 38, which rotates about the main axis 6 rigidly with the hollow shafts 13 and 15, and therefore is not twisted in any way despite the rotation of the center spindle 38.

The final portion of the paths of the first conductor 3 and of the second conductor 4 is defined by the first supporting means 5 and by the second supporting means 8.

Figure 2:
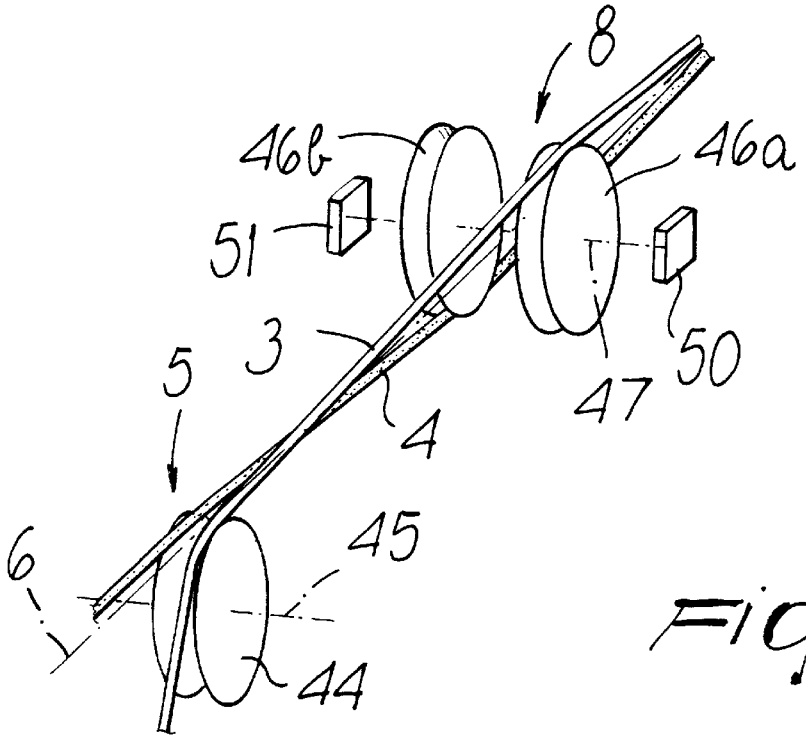
FIG. 2 is a perspective view of a detail of the machine according to the invention related to the first and second supporting means.

The first supporting means 5 can be constituted, as shown in FIG. 2, by a first pulley 44 which is supported, so that it can rotate freely about its own axis 45, inside the second hollow shaft 15.

The axis 45 of the first pulley 44 is perpendicular and spaced with respect to the main axis 6 so that its race is tangent to the main axis 6.

Figure 3:
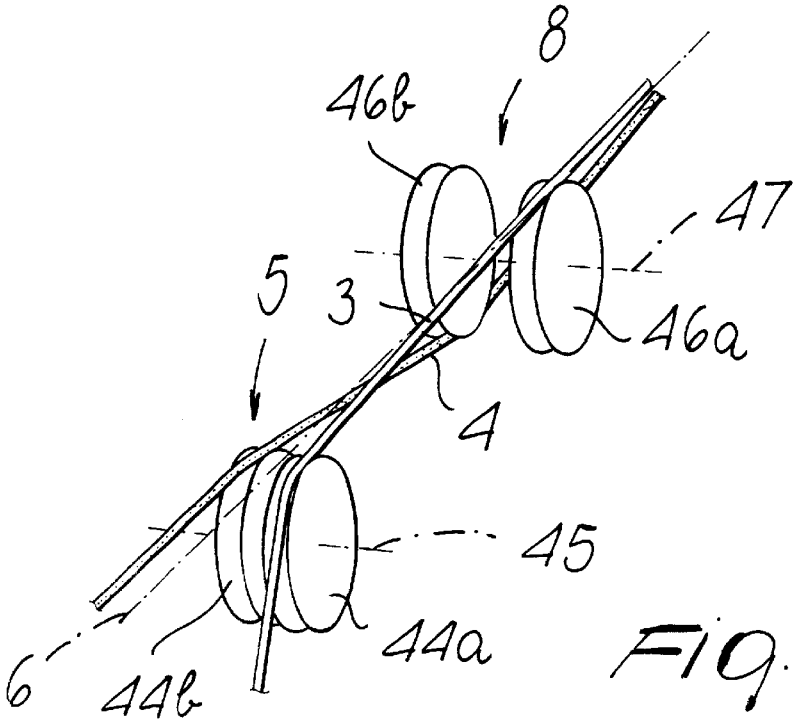
FIG. 3 is a view, similar to FIG. 2, of a further embodiment of the first and second supporting means.

As an alternative, as shown in FIG. 3, the first supporting means 5 can be constituted by two pulleys 44*a* and 44*b* which are coaxial one another and whose axis is perpendicular and spaced with respect to the main axis 6, so that their races, which can be engaged by the first conductor 3 and by the second conductor 4 respectively, lie proximate to the main axis 6 and almost coincide with it.

The first supporting means 5, instead of being constituted by two coaxial pulleys, might also be constituted by a single pulley with two races located proximate to the main axis 6, defining two contact points proximate to the main axis 6 for the two conductors 3 and 4.

In any case, the cone traced by the conductor 4 between the point where it rests on the pulley 42 and the revolving point on the pulley 44 is so small that it is contained within the passage 43, thus avoiding contact of the second conductor 4 with the center spindle 38.

The second supporting means 8 are constituted by two coaxial pulleys 46*a* and 46*b* which are supported so as to rotate freely about their own axis 47 inside the second hollow shaft 15 downstream of the first supporting means relative to the advancement direction 7.

The axis of the pulleys 46*a* and 46*b* is perpendicular to the main axis 6 and intersects said main axis 6 so that the races of said pulleys 46*a* and 46*b* define two contact points for the first conductor 3 and for the second conductor 4 respectively, said points being spaced and arranged symmetrically to each other with respect to the main axis 6.

The conductors 3 and 4 are arranged mutually side by side without intersecting between the first supporting means 5 and the second supporting means 8.

Conveniently, means for equalizing the tractions applied to the two conductors 3 and 4 are provided. Said traction equalizing means comprise means for detecting the stresses transmitted from the first conductor 3 to the pulley 46*a* and means for detecting the stresses transmitted from the second conductor 4 to the other pulley 46*b* of the second supporting means 8. The detector means are operatively connected to the first motor 21 and to the second motor 39 in order to vary the actuation torque of the motors so as to equalize the tractions applied to the conductors 3 and 4 along the final portion of their path.

The detector means are conveniently constituted by load cells 50 and 51 respectively connected to the pulleys 46*a* and 46*b*. The load cells are connected, by means of a corresponding feedback adjustment circuit, to the first motor 21 and to the second motor 39.

Substantially, the motors 21 and 39 are designed to brake, to a variable extent, the conductors 3 and 4 during their unwinding from the respective reels 20 and 34 produced by the traction applied to the cable, composed of the conductors 3 and 4, downstream of the machine 1.

The paired cable, once formed, is extracted from the machine by a traction external to the die 9: its components, divided between the conductors 3 and 4 in the portion that affects the stranding (i.e., the portion between the second supporting means 8 and the die 9) and designated by T1 and T2, are calculated by means of the value of their radial component that affects each one of the load cells 50 and 51 that constitute the physical axes of the respective guiding pulleys 46*a* and 46*b*.

The two signals, corresponding to T1 and T2, are used to control, by means of a corresponding feedback circuit, the motors 21 and 39 which adjust the unwinding of the conductors 3 and 4.

To provide uniformity and symmetry in forming the pair, it would be sufficient to provide an actuation which keeps them identical at each instant, but since the system is capable of adjusting two variables and therefore two degrees of freedom, the second degree of freedom is used to force T1 and T2 to be not only equal to each other but also constant and equal to a preset value Tcable along the entire production length, thereby obtaining a cable which has uniform characteristics throughout production and avoiding the production of tails having different characteristics which consequently would have to be rejected.

Tcable is determined, in order to simultaneously minimize damaging traction stress on the conductors and energy-related costs, as the minimum traction value that can be maintained throughout the production process of a given type of cable. Since the motors cannot push the cable, but only feed it when drawn by very low traction, Tcable cannot drop below the minimum traction required to overcome the friction that acts on the most intensely stressed extraction portion of one of the two conductors, which actually is the portion of the conductor 3 that lies between the reel 20 and the pulley 46*a* and 46*b* at maximum speed.

In practice, Tcable is determined as T1 in the combination of maximum operating speed and minimum braking action provided by the assembly constituted by the motor 21 and the reel 20 so as to avoid racing of the conductor 3.

During operation, the feedback circuit on the motors 21 and 38 forces the traction T1 to remain equal at all times to Tcable and the traction T2 to remain equal to T1.

In other words, one feedback circuit acts so as to cancel out the signal corresponding to T1-Tcable and the other feedback circuit acts so as to cancel out the signal corresponding to T2–T1.

The transmission of the signals produced by the load cells 50 and 51 to the corresponding feedback adjustment circuit occurs by adopting adapted sliding contacts 53 on the hollow shaft 15.

As they leave the pulleys 46*a* and 46*b*, the conductors 3 and 4 pass through adapted passages 54 and 55 provided in a plate which closes the end of the second hollow shaft 15 that lies opposite to the end that enters the second hollow shaft 15 and the two conductors 3 and 4 and converge inside the die 9, which forces the pairing of the two conductors 3 and 4.

The operation of the machine according to the invention is as follows.

The first conductor 3 is gradually unwound from the reel 20 and, by means of the pulley 22, is fed into the first hollow shaft 13 at the main axis 6.

The first conductor 3 is then diverted by the pulley 23 along the arch 18, which it leaves by entering the second hollow shaft 15 and resting on the race of the pulley 44 or 44*a*.

The second conductor 4 is gradually unwound from the reel 34 and leaves the space delimited by the rotation path of the arch 18 by passing through the passage 43 provided in the center spindle 38 that is rigidly coupled to the second hollow shaft 15 that supports the arms 17*a* and 17*b*.

The second conductor 4 rests in the race of the pulley 44 or in the race of the pulley 44*b*.

The rotary actuation of the arch 18 about the main shaft 6 causes the first conductor 3 to revolve around the second conductor 4.

In the portion of the path that lies between the pulley 44 or between the pulleys 44*a* and 44*b* and the pulleys 46*a* and 46*b*, the two conductors 3 and 4 never touch each other, since as mentioned the pulleys 44 or 44*a* and 44*b* and the pulleys 46*a* and 46*b* rotate jointly with the second hollow shaft 15 and therefore jointly with the arch 18.

During the advancement of the conductors 3 and 4, the load cells 50 and 51 send signals which are proportional to the traction of the conductors 3 and 4 to the corresponding feedback adjustment circuit, which equalizes the residual tractions that act at the level of the second supporting means 8 on the two conductors 3 and 4.

The perfect symmetry of the stranding action (performed by the pulleys is 46*a* and 46*b*, which revolve so as to always occupy positions which are symmetrical with respect to the axis 6, each pulley repeating the position of the other one at a distance of one half of the stranding length) and the absence of any interference caused by the advancement tractions on the two wires (which are kept strictly equal to each other and constant over time) produce a cable pair in which the individual conductors lie along two helices having the same winding direction, and which are always identical and are merely offset by half the stranding length with respect to each other.

Figure 4:
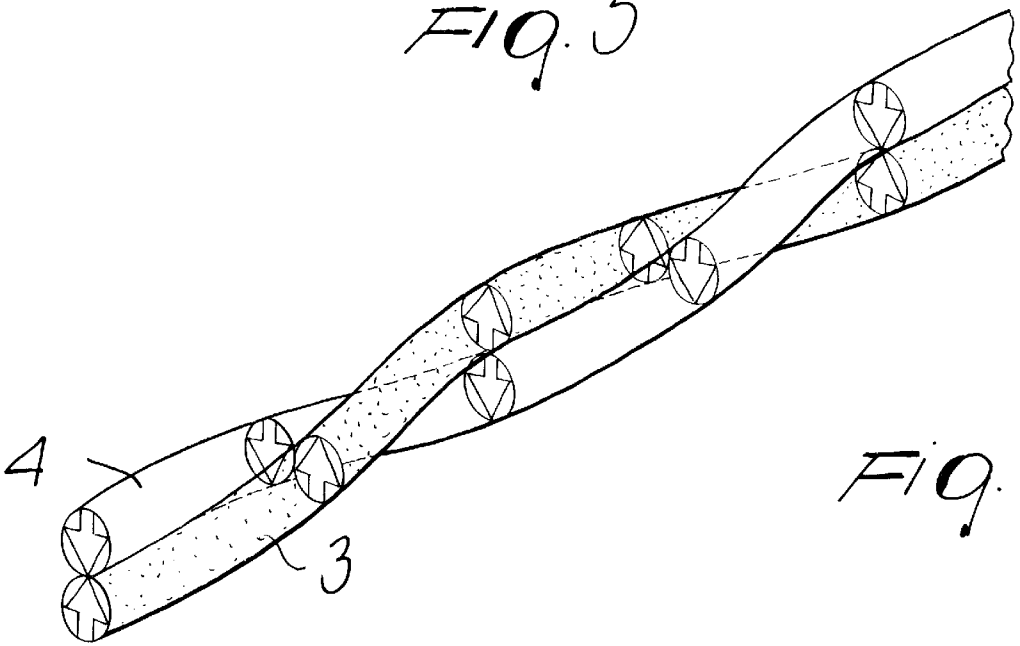
FIG. 4 is a perspective view of a cable obtained with the method according to the invention.

The absence of any twisting on the individual conductor causes no rotation in any of its transverse cross-sections, such cross-sections being subsequently deposited without modifying their original mutually parallel orientations (as shown in FIG. 4).

The absolute preservation of the electrical characteristics of the conductors (no twisting which would crack their insulation; minimization of traction stresses, which are in any case maintained well below the minimum value for constriction damage and insulation stripping) and the geometric uniformity of the deposition (in which each one of the two conductors repeats the position of the other one at a distance equal to one half of the stranding length) makes the cable thus manufactured particularly adapted for use in telecommunications.

The condition of the cable at the end of the stranding of the two conductors 3 and 4 constituting it, is shown in FIG. 4, which also shows that the orientation of each section of the conductors 3 and 4 remains identical along an entire stranding length.

Figure 5:
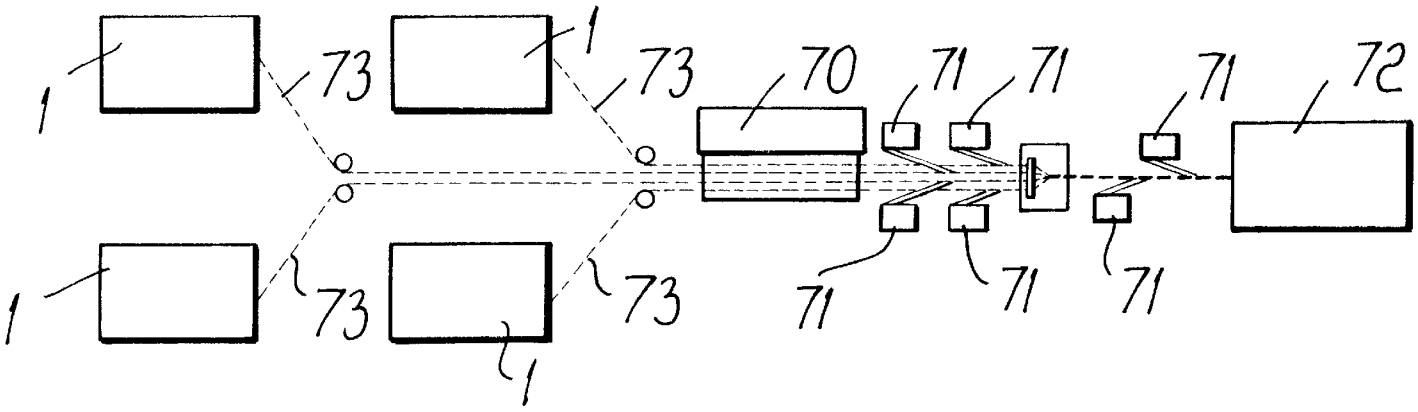
FIG. 5 is a schematic view of a line for producing cables with multiple pairs of conductors.

It should be observed that in order to provide cables composed of a plurality of pairs of conductors, it is possible to provide, as shown in FIG. 5, a plurality of machines according to the present invention arranged in parallel, providing at the output of the machines a adapted traction assembly, e.g. a capstan 70, and wrapping units 71 for fixing the various pairs 73 of conductors before bundling, which is performed by means of a wrapping and stranding machine 72 of a known type.

In practice it has been observed that the machine and the method according to the invention fully achieve the intended aim, since they allow to strand, at a high hourly production rate, pairs of conductors arranged along identical cylindrical helices which are offset one another by half the stranding length and are perfectly relieved from torsional stresses and therefore provide a perfectly identical behavior of the two conductors.

The machine and the method thus conceived are susceptible of numerous modifications and variations, all of which are within the scope of the appended claims; all the details may furthermore be replaced with other technically equivalent elements.

In practice, the materials used, as well as the dimensions, may be any according to requirements and the state of the art.

The disclosures in Italian Patent Application No. MI99A000410 from which this application claims priority are incorporated herein by reference.

What is claimed is:

1. A method for stranding two conductors in the shape of two helices, having a same winding direction, and offset by half the stranding length, comprising the steps of:

pairing two wire-like conductors by stranding the conductors in the shape of two identical helices with the same winding direction;

offsetting said helices, upon stranding of said conductors, by half the stranding length; and arranging said conductors in said helical shape by avoiding turning of the conductors about respective axes thereof.

2. The method of claim 1, comprising the additional steps of:

providing a pairing apparatus adapted for carrying out an arch-type stranding process; and pairing said two conductors, in said pairing step, by way of the pairing apparatus, so as to provide final stranding paths which are identical for the two conductors and are offset one another by any of half the stranding length and a half-turn of the pairing apparatus.

3. The method of claim 2, further comprising the step of maintaining mutually identical tractions on the two conductors, at least along said final paths, while providing helical arrangement thereof.

4. A machine for stranding two conductors in the shape of two helices, with a same winding direction, offset by half the stranding length, comprising: an arch-type stranding assembly which dispenses a first conductor and a second conductor so that said first conductor revolves around said second conductor; first supporting means for providing first contact points for said two conductors proximate to a main rotation axis, about which said first conductor revolves around said second conductor, said first supporting means being located at an exit of said arch-type stranding assembly; second supporting means for providing second points of contact for said two conductors, said second contact points being spaced and arranged symmetricaly with respect to each other relative to said main axis, said second supporting means being located downstream of said first supporting means along the advancement direction of the two conductors, with at least said first supporting means for said first conductor and said second supporting means revolving jointly with said first conductor around said main axis; and a die, being provided downstream of said second supporting means, in order to complete the pairing of said two conductors.

5. The machine of claim 4, comprising traction equalizing means for equalizing tractions applied to said conductors downstream of said arch-type stranding assembly.

6. The machine of claim 4, further comprising: a supporting structure which supports, for rotation about said main axis, an arch arranged with ends thereof lying proximate to said main axis, said arch forming a portion of the path for said first conductor; a first reel, from which said first conductor runs; a first motor for actuating said first reel; arch actuation means for actuating said arch with a revolving motion around said main axis; a second reel, supported by said supporting structure within a path traced by said arch in its rotation, said second reel being excluded from rotary motion about said main axis, and being actuatable with a rotary motion about an axs thereof; a second motor for rotating said second reel, with the path for said first conductor starting from said first reel and passing along said arch starting from an inlet end to an exit end of said arch, and with the path for said conductor starting from said second reel and running to the vicinity of said exit end of said arch, said first supporting means for the conductors and said second supporting means for the conductors being coupled to said arch for joint rotary motion about said main axis, and being arranged in sequence starting from a region that lies proximate to said exit end of said arch in order to form a final portion of the path of said two conductors.

7. The machine of claim 6, wherein said second reel is arranged with the axis thereof being perpendicular to said main axis.

8. The machine of claim 6, further comprising a first hollow shaft whose axis coincides with said main axs, said arch being rigidly connected with the inlet end thereof to said first hollow shaft; and a second hollow shaft which is coaxial to said first hollow shaft, said arch being rigidly connected with the outlet end thereof to said second hollow shaft, said first and second hollow shafts being supported so as to be rotatable about the main axs by said supporting structure, said supporting structure being constituted by an external static structure resting on the ground; and said first supporting means comprising at least one first pulley having a central axs thereof and at least one race which is engageable by said conductors; and said second supporting means comprising at least two coaxial pulleys, each of which defines a race which is engageable by one of said conductors; the central axis of said first pulley being arranged at right angles to said m axis and being spaced from the main axis in order to arrange the race thereof tangent to said main axis; and wherein the axes of said two pulleys are arranged at right angles to said main axis and intersect said main axis; said at least one first pulley and said two pulleys being supported, so as to be freely rotatable about their respective axes, inside said second hollow shaft.

9. The machine of claim 8, wherein said at least one first pulley is constituted by a pulley with two side-by-side races.

10. The machine of claim 8, comprising two first pulleys which are rigidly coupled to each other in order to individually support said two conductors.

11. The machine of claim 8, comprising a frame, on which said second reel is mounted, said frame being supported, so as to be freely rotatable about said main axis, by said first hollow shaft and by said second hollow shaft.

12. The machine of claim 8, wherein between said at least one first pulley and said two pulleys the paths of said two conductors are set so as to run side by side without intersecting one another.

13. The machine of claim 12, comprising traction equalizing means for equalizing tractions applied to said conductors downstream of said arch-type stranding assemnbly wherein said traction equalizing means comprise detector means for detecting stresses transmitted from said first conductor to one of said two pulleys of ad second supporting means, and detector means for detecting stresses transmitted from said second conductor to the other one of said two pulleys of the second supporting means, said detector means being operatively connected to said first motor and to said second motor in order to vary actuation torques of said motors so as to equalize the tractions applied to said conductors along said final portion of their path.

14. The machine of claim 13, wherein said detector means are constituted by load cells which are connected to said pulleys, said load cells being further connected, in a feedback adjustment arrangement, to said first motor and to said second motor.

* * * * *